US006855437B2

(12) United States Patent
Tolls et al.

(10) Patent No.: US 6,855,437 B2
(45) Date of Patent: Feb. 15, 2005

(54) DECORATIVE COATINGS HAVING RESISTANCE TO CORROSION AND WEAR

(75) Inventors: Elmar Tolls, deceased, late of Willich (DE); by Hiltrud Tolls, legal representative, Willich (DE)

(73) Assignee: Enthone Inc., West Haven, CT (US)

( * ) Notice: Subject to any disclaimer, the term of this patent is extended or adjusted under 35 U.S.C. 154(b) by 25 days.

(21) Appl. No.: 10/182,969

(22) PCT Filed: Jan. 26, 2001

(86) PCT No.: PCT/US01/00654

§ 371 (c)(1),
(2), (4) Date: Nov. 22, 2002

(87) PCT Pub. No.: WO01/56781

PCT Pub. Date: Aug. 9, 2001

(65) Prior Publication Data

US 2003/0211353 A1 Nov. 13, 2003

(30) Foreign Application Priority Data

Feb. 2, 2000 (DE) ..... 100 04 555

(51) Int. Cl.[7] ..... B32B 15/00

(52) U.S. Cl. ..... 428/667; 428/613; 428/627; 428/632; 428/637; 428/660; 428/666; 428/674; 428/675; 428/679; 428/680; 428/686; 428/698; 428/927; 428/938

(58) Field of Search ..... 428/667, 613, 428/627, 632, 637, 660, 666, 674, 675, 679, 680, 686, 698, 927, 938

(56) References Cited

U.S. PATENT DOCUMENTS 4,511,631 A 4/1985 Fujimoto et al.
4,960,653 A 10/1990 Yokoi
5,626,972 A 5/1997 Moysan, III et al.

*Primary Examiner*—Robert R. Koehler
(74) *Attorney, Agent, or Firm*—Senniger Powers

(57) ABSTRACT

The subject of the invention is a layer system for the decorative coating of galvanizable work pieces. In order to have a layer system which meets strict requirements with regard to corrosion resistance and which, at the same time, has a high abrasion resistance and, in addition, provides a high degree of freedom with regard to decorative coloration, the invention proposes a layer system which is formed by galvanic deposition and comprises a base coat consisting of at least one bright layer and one discontinuous chrome layer as well as a cover coat of mechanically resistant materials deposited by the PVD process.

33 Claims, No Drawings

DECORATIVE COATINGS HAVING RESISTANCE TO CORROSION AND WEAR

BACKGROUND OF THE INVENTION

The invention refers to a coating system for the decorative layering of work pieces, which can be galvanized.

Coating systems of this type are known from the current state of the art, and they are applied especially in the automotive and the furniture manufacturing industry, as well as in the sanitary equipment area. The possible variety of galvano-decorative coatings is in an upward trend, involving the coating of not only basic materials consisting of iron or zinc but also a variety of basic materials such as plastics, for example. Of special interest in this connection are the typically possible metallic matte and bright effects. In order to protect against discoloration and corrosion, these matte and bright effect generating layers are generally covered with a chromium layer, which usually has a blue-silver appearance and therefore fills numerous decorative requirements. For the protection of a metallic base material, coating systems are preferred which contain copper, nickel and chrome or nickel and chrome. Provided that the metals forming the protective coat are more noble than the base material, such a system provides corrosion protection since corrosion only occurs if the protective coat has irregularities such as pores or grooves, for example, which extend to the base material. This limited corrosion resistance of the currently known coating systems, however, increasingly no longer can meet the stringent requirements of the automotive industry.

In addition to an improvement of resistance to corrosion, the use of a decorative coating has the aim to create an improved over-all appearance. With respect to coloration, the blue-silver appearing chrome cover coat can be replaced by tin, silver, gold, palladium or rhodium, for example. However, the disadvantage is that with this type of substitute cover coats neither good corrosion protection nor a high degree of wear resistance can be achieved.

In order to improve the wear resistance it is known from the current state of the art to form a mechanically resistant material coat by means of a vacuum coating process, using mechanically resistant material particles such as titanium or zirconium compounds, for example, and thus creating a cover coat with a higher degree of wear resistance. Here, two different basic vacuum coating processes exist for the deposition of mechanically resistant material coatings: CVD (chemical vapor deposition) and PVD (physical vapor deposition). Both processes, however, share the disadvantage of the mechanically resistant material coats in the customary coat thickness range being too porous, and therefore they cannot contribute anything to the corrosion protection of the over-all coating system. As a result, even a coating system, which has a mechanically resistant material coat as the cover coat, does not meet the corrosion resistance requirements.

SUMMARY OF THE INVENTION

Therefore it is the intent of the invention to provide a coating system which avoids the above-mentioned disadvantages and which meets strict corrosion resistance requirements and, at the same time, has a high degree of wear resistance and furthermore offers a variety of choices with regard to the decorative coloration.

According to the invention this problem is solved by a coating system for decorative coating of work pieces which can be galvanized and which have a bright coat and a discontinuous chrome coat as a base coat, as well as a cover coat of mechanically resistant material which is deposited using the PVD process.

DETAILED DESCRIPTION OF THE PREFERRED EMBODIMENT

The process, which is the subject of the invention, proposes first a coating system, which both meets strict requirements for corrosion resistance and also shows a high degree of wear resistance. This is achieved by the galvanic deposition of a discontinuous chrome coat as the base coat to achieve a high degree of corrosion resistance on the one hand and by the formation of a cover coast of mechanically resistant material to achieve a high degree of wear resistance on the other hand. Research, by the CASS test for example, has shown that the corrosion protection achievable with the coating system, which is the subject of the invention fully, meets the requirements of the automotive industry. In addition, it turns out that the coating system, which is the subject of the invention also, demonstrates a high degree of wear and abrasion resistance.

In order to achieve an optically attractive over-all appearance, depending on the desired coloration, different mechanically resistant materials can be used to form the cover coat. For example, the use of TiC produces an anthracite colored cover coat, and a mixture of TiN and ZrN can achieve gold tones in accordance with the gold standard. Various colorations, such as pink or bluish coatings, for example, are possible as surface effects.

With the coating system, which is the subject of the invention, a galvano-decorative coating is made available which corresponds to today's requirements regarding corrosion and wear resistance and which, at the same time, offers many opportunities for decorative coloration.

In accordance with one characteristic of the invention, the discontinuous chrome coat is a layer with micro-cracks or micro-pores. For the formation of a micro porous chrome coat it is necessary to first form a nickel dispersion layer on the surface of the work piece and to subsequently cover it with a chrome layer. The formation of a micro-porous chrome coat is the result of the nickel dispersion layer. A direct micro-porous chrome deposition has not been possible to date. By contrast, micro-cracked chrome coats can be produced directly on any nickel coat in a one-step process or with the double chrome plating process. Micro-crack chrome plating can also be produced by the deposition of cracked nickel coats. Compared to the one or two-step micro-cracked chrome coating process the cracked nickel electrolyte shows a better control of the crack depth, leading to a more even micro-crack chrome coating. Advantageously, as a discontinuous chrome coat, both the micro-cracked and the micro-porous chrome coat offer excellent corrosion protection which meets strict requirements and which represents an improvement over conventional coating systems.

In accordance with an additional characteristic of the invention, the bright coat is a bright nickel or a pearl bright nickel coat which advantageously shows bright or matte surface effects which can be attuned to the over-all optical appearance. For example, by forming a pearl bright nickel coat, non-glaring nickel plating can be achieved which, in contrast to bright nickel plating, forms a surface with a silky, matte appearance.

In accordance with an additional characteristic of the invention, the base coat shows a further nickel layer between the bright coat and the discontinuous chrome layer. This nickel layer is a nickel dispersion coat and serves for the formation of a micro-porous chrome coat. In this manner, the nickel dispersion coat forms a surface with embedded, non-conducting particles which has the result that when applying a chrome coat, pores are formed at the location of the embedded particles, whereby a micro-porous chrome coat is formed. A chrome coat of this type has the advantage of high corrosion resistance.

In accordance with an additional characteristic of the invention, the base coat has a nickel layer below the bright coat in the direction of thickness, whereby it is advantageous for this to be a coat of sulfur-free, columnar nickel. In this manner a multiple nickel coating system is formed in connection with the bright nickel or the pearl bright nickel coat and the nickel dispersion coat which shows a particularly high resistance to corrosion.

In accordance with an additional characteristic of the invention, the base coat shows a copper layer at the bottom, in the direction of thickness.

In accordance with an additional characteristic of the invention, elements of the IV complex are preferred to be used as mechanically resistant materials, especially titanium, zirconium and hafnium, combinations thereof and/or their nitrides, oxides or carbides. The use of mechanically resistant materials of this type has the advantage that it provides the possibility to form a cover coat, which has a high abrasion resistance and thus a high wear resistance. In addition, the coloration of the layered system can be selected and adjusted by the choice of the mechanically resistant materials. The deposition of the cover coat is by gas phase precipitation, whereby it can be differentiated between CVD (chemical vapor deposition) and PVD (physical vapor deposition) processes. The important characteristic of the PVD process here is that a metallic cathode is vaporized as the target and that this metal vapor, in turn, precipitates on the work piece surface under the controlled addition of reaction gases, for example as a nitride or carbide.

In general, a coating technology is proposed by the layering system described in the invention which makes possible a great variety of decorative coatings with respect to brightness or matte effects as well as with respect to coloration, and which simultaneously meets the strictest requirements for corrosion and abrasion resistance.

What is claimed is:

1. A decorative coating for a galvanizable surface comprising:

a base coat comprising a bright layer and a discontinuous chrome layer; and a cover coat over the base coat comprising a mechanically resistant material.

2. The decorative coating according to claim 1 wherein the discontinuous chrome layer is formed by a galvanizable deposition process.

3. The decorative coating according to claim 1 wherein the cover coat is formed by a physical vapor deposition process.

4. The decorative coating according to claim 1 wherein the base coat further comprises a sulfurless, columnar nickel layer which is located between the galvanizable surface and the bright layer.

5. The decorative coating according to claim 1 further comprising a copper layer which is located between the galvanizable surface and the base coat.

6. The decorative coating according to claim 1 wherein the mechanically resistant material comprises a substance selected from the group consisting of a Group IV B element, a nitride of a Group IV B element, an oxide of a Group IV B element, and a carbide of a Group IV B element.

7. The decorative coating according to claim 6 wherein the Group IV B element is selected from the group consisting of titanium, zirconium, and hafnium.

8. The decorative coating according to claim 6 wherein the mechanically resistant material comprises a substance selected from the group consisting of titanium carbide, titanium nitride, and zirconium nitride.

9. The decorative coating according to claim 1 wherein the bright layer is selected from the group consisting of a bright nickel layer and a pearl bright nickel layer.

10. The decorative coating according to claim 9 wherein the base coat further comprises a sulfurless, columnar nickel layer which is located between the galvanizable surface and the bright layer.

11. The decorative coating according to claim 9 further comprising a copper layer which is located between the galvanizable surface and the base coat.

12. The decorative coating according to claim 9 wherein the mechanically resistant material comprises a substance selected from the group consisting of a Group IV B element, a nitride of a Group IV B element, an oxide of a Group IV B element, and a carbide of a Group IV B element.

13. The decorative coating according to claim 12 wherein the Group IV B element is selected from the group consisting of titanium, zirconium, and hafnium.

14. The decorative coating according to claim 12 wherein the mechanically resistant material comprises a substance selected from the group consisting of titanium carbide, titanium nitride, and zirconium nitride.

15. The decorative coating according to claim 1 wherein the base coat further comprises a nickel dispersion layer which is located between the bright layer and the discontinuous chrome layer.

16. The decorative coating according to claim 15 wherein the discontinuous chrome layer comprises micropores.

17. The decorative coating according to claim 15 wherein the base coat further comprises a sulfurless, columnar nickel layer which is located between the galvanizable surface and the bright layer.

18. The decorative coating according to claim 15 further comprising a copper layer which is located between the galvanizable surface and the base coat.

19. The decorative coating according to claim 15 wherein the mechanically resistant material comprises a substance selected from the group consisting of a Group IV B element, a nitride of a Group IV B element, an oxide of a Group IV B element, and a carbide of a Group IV B element.

20. The decorative coating according to claim 19 wherein the Group IV B element is selected from the group consisting of titanium, zirconium, and hafnium.

21. The decorative coating according to claim 19 wherein the mechanically resistant material comprises a substance selected from the group consisting of titanium carbide, titanium nitride, and zirconium nitride.

22. The decorative coating according to claim 1 wherein the discontinuous chrome layer comprises microcracks.

23. The decorative coating according to claim 22 wherein the bright layer is a cracked nickel layer.

24. The decorative coating according to claim 1 wherein the discontinuous chrome layer is formed by a galvanizable deposition process and the cover coat is formed by a physical vapor deposition process.

25. The decorative coating according to claim 24 wherein the bright layer is selected from the group consisting of a bright nickel layer and a pearl bright nickel layer.

26. The decorative coating according to claim 24 wherein the base coat further comprises a nickel dispersion layer which is located between the bright layer and the discontinuous chrome layer.

27. The decorative coating according to claim 24 wherein the base coat further, comprises a sulfurless, columnar nickel layer which is located between the galvanizable surface and the bright layer.

28. The decorative coating according to claim 24 further comprising a copper layer which is located between the galvanizable surface and the base coat.

29. The decorative coating according to claim 24 wherein the mechanically resistant material comprises a substance selected from the group consisting of a Group IV B element, a nitride of a Group IV B element, an oxide of a Group IV B element, and a carbide of a Group IV B element.

30. The decorative coating according to claim 29 wherein the Group IV B element is selected from the group consisting of titanium, zirconium, and hafnium.

31. The decorative coating according to claim 29 wherein the mechanically resistant material comprises a substance selected from the group consisting of titanium carbide, titanium nitride, and zirconium nitride.

32. A decorative coating for a galvanizable surface, the coating comprising:

a copper layer;

a base coat comprising a sulfurless, columnar nickel layer, a bright layer, and a discontinuous chrome layer; and a cover coat;

wherein the copper layer is located between the galvanizable surface and the base coat;

wherein the base coat is located between the copper layer and the cover coat;

wherein the sulfurless, columnar nickel layer is located between the copper layer and the bright layer; and wherein the bright layer is located between the sulfurless, columnar nickel layer and the discontinuous chrome layer.

33. The decorative coating according to claim 32 wherein the base coat further comprises a nickel dispersion layer which is located between the bright layer and the discontinuous chrome layer.

* * * * *